United States Patent [19]

Thompson

[11] 4,008,872

[45] Feb. 22, 1977

[54] MODULE SUPPORTING SYSTEM

[76] Inventor: Richard W. Thompson, Rte. 7 Box 7796, Port Madison, Bainbridge Island, Wash. 98110

[22] Filed: Oct. 8, 1975

[21] Appl. No.: 620,745

[52] U.S. Cl. ..... 248/224.2; 52/27; 211/88

[51] Int. Cl.[2] ..... A47F 5/00; B65D 31/00

[58] Field of Search ..... 248/225, 224, 215; 211/88, 94; 220/18; 312/245, 246; 52/27

[56] References Cited

UNITED STATES PATENTS

| | | | |
|---|---|---|---|
| 602,195 | 4/1898 | Pfau | 312/245 UX |
| 1,055,758 | 3/1913 | Knapp | 52/27 |
| 1,794,949 | 3/1931 | Frank | 248/233 |
| 3,255,913 | 6/1966 | Helm | 220/18 |
| 3,311,435 | 3/1967 | Heritage | 248/224 X |
| 3,526,314 | 9/1970 | Trammell | 220/18 X |
| 3,908,831 | 9/1975 | Brendgord | 312/245 X |

FOREIGN PATENTS OR APPLICATIONS

| | | | |
|---|---|---|---|
| 62,905 | 5/1924 | Sweden | 248/232 |

*Primary Examiner*—J. Franklin Foss
*Attorney, Agent, or Firm*—Harris, Kern, Wallen & Tinsley

[57] ABSTRACT

A module supporting system comprising a supporting structure having a front side provided with a horizontal groove therein, an upwardly facing hook within and extending longitudinally of the groove adjacent the bottom thereof and secured to the supporting structure, a module having a rear side adapted to abut the front side of the supporting structure, and a horizontally extending, downwardly facing hook secured to and projecting rearwardly from the rear side of the module, the downwardly facing hook being complementary to and interengageable with the upwardly facing hook, with the rear side of the module abutting the front side of the supporting structure. With this construction, the weight of the module is carried by the hooks without imparting any twisting forces to the hooks.

1 Claim, 3 Drawing Figures

MODULE SUPPORTING SYSTEM

BACKGROUND OF THE INVENTION

The present invention relates to a module supporting system and, more particularly, to a supporting system for mounting any desired module on any suitable supporting structure. The supporting structure may be the wall of a room, a wall at a work station, the rear wall or modesty skirt of a desk, or the like. The module or modules to be mounted on the supporting structure may include such things as bins, cabinets, drawer assemblies, shelves or shelf assemblies, or the like. In other words, both the supporting structure, and the module or modules to be mounted thereon, may be virtually anything whatsoever.

SUMMARY AND OBJECTS OF INVENTION

The invention may be summarized as comprising, and a primary object thereof is to provide a module supporting system which includes: a supporting structure having a front side provided with a recess therein; an upwardly facing hook within the recess and secured to the supporting structure; a module having a rear side adapted to abut the front side of the supporting structure; and a downwardly facing hook secured to and projecting rearwardly from the rear side of the module, the downwardly facing hook being complementary to and interengageable with the upwardly facing hook within the recess in the front side of the supporting structure, with the rear side of the module abutting the front side of the supporting structure.

Since, with the foregoing construction, the rear side of the module abuts the front side of the supporting structure upon interengagement of the two hooks, no twisting or torsional forces are applied to the hooks, the hooks being required to sustain vertical loads only, which is an important feature of the invention.

More particularly, an important object of the invention is to provide a module supporting system wherein the recess in the front side of the supporting structure is a horizontal groove extending the full width of the supporting structure, wherein the upwardly facing hook within the groove extends longitudinally the full length of such groove adjacent the bottom thereof, and wherein the downwardly facing hook on the module extends horizontally of the module, preferably the full width thereof. With this construction, the weight of the module is applied to the interengaged hooks throughout the full width of the module, and, if the width of the module is less than that of the supporting structure, two or more modules can be hung from the upwardly facing hook within the groove in the front side of the supporting structure.

Another object is to provide a construction wherein the module carries adjacent the bottom thereof adjustable means engageable with the front side of the supporting structure to compensate for any deformation of the front side of the supporting structure which might tend to impart torsional forces to the interengaged hooks. Such an adjustable means is particularly desirable where the front side of the supporting structure is faced with a deformable material, such as carpeting.

The foregoing objects, advantages, features and results of the present invention, together with various other objects, advantages, features and results which will be evident to those skilled in the art to which the invention relates in the light of this disclosure, may be achieved with the exemplary embodiments of the invention illustrated in the accompanying drawing and described in detail hereinafter.

DESCRIPTION OF EXEMPLARY EMBODIMENTS OF INVENTION

Figure 1:
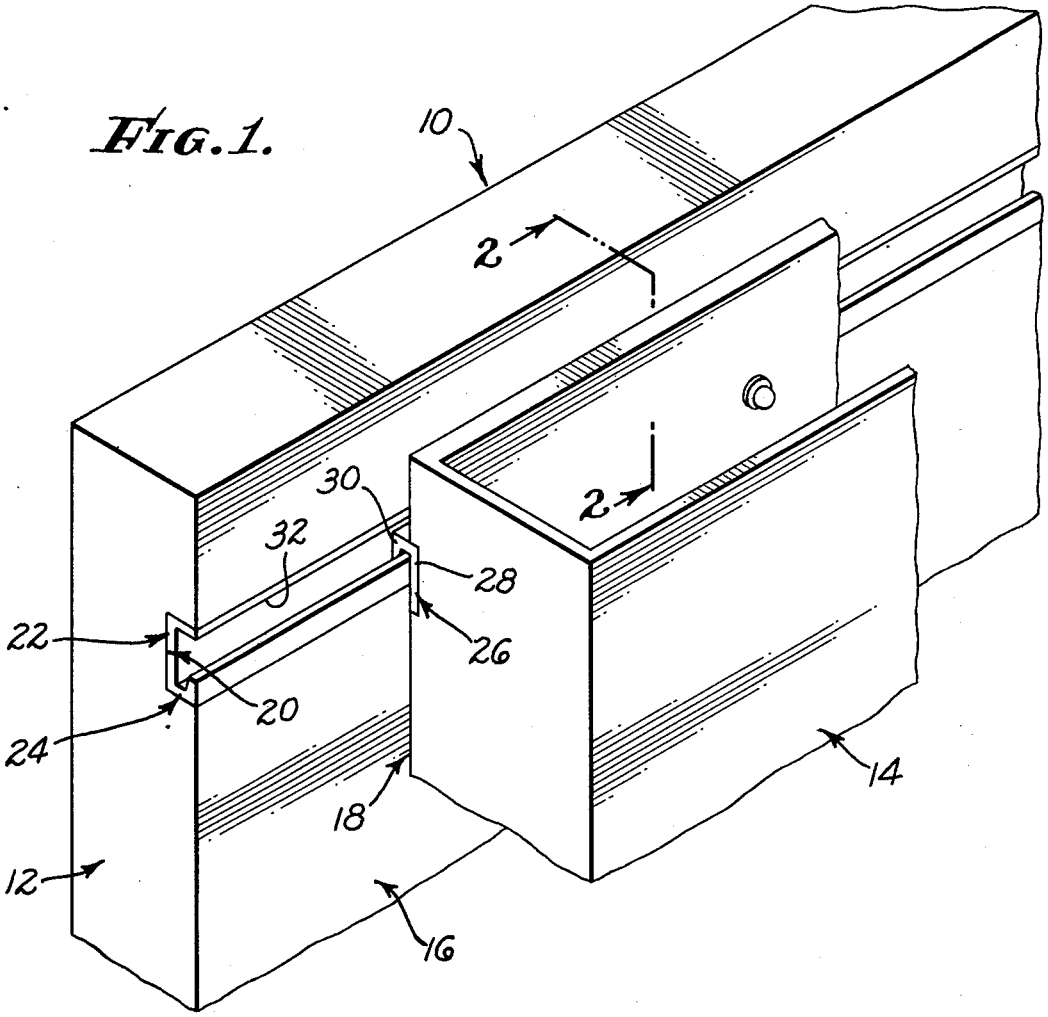
FIG. 1 is a fragmentary isometric view of a module supporting system which embodies the invention.

Referring to the drawing, the module supporting system of the invention is designated generally therein by the numeral 10 and comprises any suitable supporting structure 12, shown as a simple wall, on which is mounted any desired module 14, shown as a simple bin. The supporting structure 12 has a front side 16 and the module 14 has a rear side 18.

The front side 16 of the supporting structure 12 is provided therein with a horizontal groove 20 preferably extending the full width of the supporting structure. Within the groove 20, and thus recessed into the front side 16 of the supporting structure 12, is a generally channel-shaped member 22 which provides an upwardly facing hook 24 within and extending longitudinally of the groove adjacent the bottom thereof. The member 22 is suitably secured to the supporting structure 12, as by screws, one of which is shown in dotted lines in FIG. 2.

Figure 2:
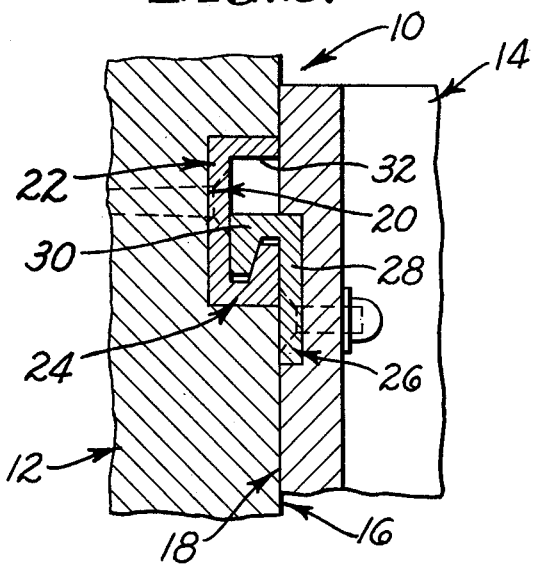
FIG. 2 is an enlarged, fragmentary sectional view taken as indicated by the arrowed line 2—2 of FIG. 1.

A horizontally extending member 26 is suitably secured to the rear side of the module 14, as by screws or bolts one of which is shown in FIG. 2. Preferably, the member 26 extends the full width of the module 14.

The member 26 comprises a flange 28 which is recessed into the rear side 18 of the module 14, such flange being provided along its upper edge with a horizontally extending, downwardly facing hook 30 projecting rearwardly from the rear side 18 of the module 14. The member 22 within the groove 20 is provided along its front with a gap 32 the height of which is greater than the height of the hook 30. Consequently, the module 14 may be hung from the supporting structure 12 readily merely by inserting the hook 30 through the gap 32 into engagement with the hook 24. It will be understood, of course, that the hooks 24 and 30 are complementary and interengageable, as shown in FIG. 2 of the drawing.

Since the upwardly facing hook 24 is recessed into the supporting structure 12, and since the downwardly facing hook 30 projects rearwardly from the module 14, the rear side 18 of the module abuts the front side 16 of the supporting structure when the hooks 24 and 30 are interengaged, as will be clear from FIGS. 1 and 2 of the drawing. Such abutment of the rear side 18 of the module 14 against the front side 16 of the supporting structure 12 insures that no twisting or torsional forces are applied to the hooks 24 and 30, such hooks thus being required to resist vertical loads only. Further, twisting or torsional forces acting on the hooks 24 and 30 are precluded without any structure other than the module 14 and the supporting structure 12 themselves, which is an important feature.

Figure 3:
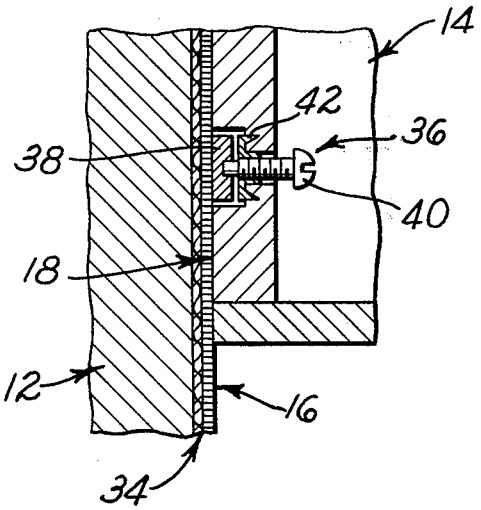
FIG. 3 is a vertical sectional view through the module supporting system adjacent the bottom of a module thereof, and showing an alternative adjustable means carried by the module and engageable with the front side of the supporting structure to compensate for any deformation thereof.

Referring to FIG. 3 of the drawing, it is sometimes desirable for decorative, or other purposes, to face the supporting structure 12 with a deformable material 34, such as carpeting, which forms the extreme front surface 16 of the supporting structure. If the facing layer 34 is sufficiently deformable that the weight of the module 14, and any load carried thereby, tends to impart twisting or torsional forces to the hooks 24 and 30, this can be prevented by an adjustable means 36, FIG. 3, carried by the module 14 and engageable with the facing layer 34. The adjustable means 36 comprises a pad 38 engageable with the facing layer 34 and actuated by a screw 40 threaded through a nut 42 carried by the rear side of the module 14. The pad 38 is recessed into the rear side 18 of the module 14. If desired, the pad 38 may extend the full width of the module 14, and may be actuated by two or more of the screws 40.

As will be apparent, if the module 14 tends to compress the facing layer 34 sufficiently to impart twisting forces to the hooks 24 and 30, this can be prevented by adjusting the screw or screws 40 to move the pad 38 rearwardly sufficiently until such twisting forces are eliminated. It will be understood that the adjustable means 36 is not necessary where the front side 16 of the supporting structure 12 and the rear side 18 of the module 14 are nondeformable, or at least not readily deformable.

Although exemplary embodiments of the invention have been disclosed for illustrative purposes, it will be understood that various minor changes, modifications and substitutions may be incorporated in such embodiments without departing from the invention as hereinafter claimed.

I claim as my invention:

1. In a module supporting system, the combination of:

a. a supporting structure having a front side provided with a horizontal groove therein;

b. an upwardly facing hook within and extending longitudinally of said groove adjacent the bottom thereof and secured to said supporting structure, there being a longitudinal gap between said upwardly facing hook and the top of said groove;

c. a module having a rear side adapted to abut said front side of said supporting structure;

d. a horizontally extending, downwardly facing hook secured to and projecting rearwardly from said rear side of said module, said downwardly facing hook being complementary to and interengageable with said upwardly facing hook within said groove in said front side of said supporting structure, with said rear side of said module abutting said front side of said supporting structure, the height of said downwardly facing hook being less than the height of said gap to permit insertion of said downwardly facing hook through said gap, and into engagement with said upwardly facing hook, simply by moving said module rearwardly into abutting relation with said supporting structure;

e. said downwardly facing hook comprising part of a horizontally extending supporting member recessed into said rear side of said module;

f. said groove and said upwardly facing hook therein extending the full width of said supporting structure, and the width of said module being less than the width of said supporting structure, said downwardly facing hook extending the full width of said module; and g. said module carrying adjacent the bottom thereof adjustable means engageable with said front side of said supporting structure to compensate for deformation of said front side of said supporting structure.

* * * * *